US006341967B1

(12) United States Patent
Nabeshima et al.

(10) Patent No.: US 6,341,967 B1
(45) Date of Patent: Jan. 29, 2002

(54) CONNECTOR BLOCK FOR INJECTOR

(75) Inventors: Akira Nabeshima, Yokkaichi; Masahiro Takeda, Toyoake; Masaki Akutagawa, Chiryu, all of (JP)

(73) Assignees: Sumitomo Wiring Systems, Ltd., Mie; Denso Corporation, Kariya, both of (JP)

( * ) Notice: Subject to any disclaimer, the term of this patent is extended or adjusted under 35 U.S.C. 154(b) by 0 days.

(21) Appl. No.: 09/721,876

(22) Filed: Nov. 27, 2000

(30) Foreign Application Priority Data

Nov. 26, 1999 (JP) ..... 11-336446

(51) Int. Cl.[7] ..... H01R 13/44; H01R 31/08

(52) U.S. Cl. ..... 439/130; 439/507; 439/510; 439/949

(58) Field of Search ..... 439/130, 212, 439/507, 949, 76.2, 49, 510–512, 213

(56) References Cited

U.S. PATENT DOCUMENTS 5,030,116 A 7/1991 Sakai et al.
5,063,314 A * 11/1991 DeSantis ..... 439/510

FOREIGN PATENT DOCUMENTS

JP 8-284773 10/1996

* cited by examiner

*Primary Examiner*—P. Austin Bradley
*Assistant Examiner*—Felix O. Figueroa
(74) *Attorney, Agent, or Firm*—Oliff & Berridge, PLC

(57) ABSTRACT

By dividing a bus bar group 65 into a pair of subordinate bus bar groups 65A, 65B, tabs 31 extending from the bus bar group 65 in mutually different oblique directions can be held in a metal mold separately. Due to this, the bus bar group 65 can also be set in a metal mold including a slide mold 3, which makes it possible to manufacture a connector block 20 with high efficiency.

3 Claims, 14 Drawing Sheets

CONNECTOR BLOCK FOR INJECTOR

BACKGROUND OF THE INVENTION

1. Field of the Invention

The present invention relates to a connector block which can be connected to an injector (a fuel injection valve) for use in an automobile.

2. Description of the Related Art

Now, FIG. 1 shows an example of the outer shape of a connector block 10 for an injector (which is hereinafter referred to as a connector block 10 simply). This connector block 10 is a device which is to be mounted into, for example, a V-type 6-cylinder engine (not shown); and, the connector block 10 comprises a housing 21 formed of heat resistant reinforced hard resin so as to have an elongated shape and also, conventionally, a group of bus bars 1 which are shown in FIG. 15.

By the way, referring to the structure of a V-type engine, a plurality of (for example, six) cylinders arranged along a crankshaft are inclined right and left every other cylinder to thereby provide a pair of cylinder groups and, as shown in FIG. 2, a plurality of injectors 51 (for example, by threes in each cylinder group) are projected obliquely upward from the two cylinder heads H, H of these right and left cylinder groups toward the centers of the two cylinder heads H, H. Here, in FIG. 2, of the two injector groups 50A, 50B respectively projected from the two cylinder heads H, H, there are shown two injectors 51, 51, that is, one injector in each injector group.

Now, the connector block 10, as shown in FIG. 2, includes, on the lower surface 21D of the housing, 21, a pair of injector connecting portion groups 25A, 25B to which the injector groups 50A, 50B can be respectively connected and, on the upper surface 21U of the housing 21, a wire connecting portion 22 to which an external wire 80, shown in FIG. 1. can be connected. And, the bus bar group 1 (see FIG. 15) extend over the individual injector connecting portions 25 of the respective injector connecting portion groups 25A, 25B as well as the wire connecting portion 22. Also, in the bus bar group 1, there are disposed a plurality of tabs 31 to be exposed in the respective injector connecting portions in such a manner that they are divided into a pair of tab groups 31A, 31B (see FIG. 15) respectively facing in obliquely downward directions which are different from each other.

By the way, as described above, since the bus bar group 1 includes the tab groups 31A, 31B which respectively face in the mutually different directions, to mold the housing 21, it is necessary to use a metal mold including such a slide mold 3 as shown in FIG. 17, or a metal mold including such a core 5 as shown in FIG. 18.

However, conventionally, for the following reason, there is no choice but to use a metal mold including a core 5 which is poor in operation efficiency. That is, in the conventional bus bar group 1, a grounding bus bar 8 shown in FIG. 16 is structured such that a pair of main body portions 8S, 8S thereof including a plurality of tabs 31 in correspondence to the respective injector connecting portion groups 25A, 25B are connected together through a horizontal branch portion 8H thereof; and, the grounding bus bar 8 and other power supply bus bars 9, as shown in FIG. 15, are unified by a holder 63 formed of synthetic resin, thereby forming one bus bar group 1. For this reason, as shown in FIG. 17, the two tab groups 31A, 31B differing in the facing direction are unified and thus cannot be inserted into a tab hold hole 4 formed in the slide mold 3, which makes it impossible to set the bus bar group 1 into the metal mold including the slide mold 3. By the way, even in case where the slide mold 3 is retreated once, the bus bar group 1 is set into the metal mold and, after then, the slide mold 3 is inserted again, because the leading end of the tab 31 is not positioned, the tab 31 cannot be inserted into the tab hold hole 4 of the slide mold 3, either.

Therefore, conventionally, as shown in FIG. 18, there is no choice but to use the metal mold including the core 5. Specifically, to mold the housing 21, there must be carried out the following extremely troublesome operations: that is, firstly, the core 5 is mounted on the bus bar group 1 (see FIG. 18); and, after then, the bus bar group 1 together with the core 5 is set into a metal mold main body 6, a product is taken out from the metal mold after the housing 21 is molded, and the core 5 is removed from the product.

SUMMARY OF THE INVENTION

The present invention aims at eliminating the drawbacks found in the above-mentioned conventional connector block for an injector. Accordingly, it is an object of the invention to provide a connector block for an injector which allows a bus bar group to be set in a metal mold including a slide mold and thus can be manufactured with high efficiency.

In attaining the above object, according to a first aspect of the invention, there is provided a connector block for an injector, comprising a housing molded by setting a bus bar group in a metal mold for resin molding, the housing including a wire connecting portion for connection with an external wire and a pair of injector connecting portion groups disposed in the lower surface of the housing for connection with a plurality of injectors from mutually different oblique downward directions, the bus bar group extending over the respective injector connecting portions and wire connecting portion, wherein the bus bar group is set in the metal mold while the bus bar group is divided into a pair of subordinate bus bar groups in correspondence to the pair of injector connecting portion groups, and the subordinate bus bar groups respectively include branched bus bars branched from the wire connecting portions and extending to the respective injector connecting portions, and also wherein the branched bus bars disposed in the two subordinate bus bar groups include a pair of short-circuit tabs to be conduction connected with each other by an external wire or by a short-circuit terminal.

Also, according to a second aspect of the invention, in a connector block for an injector as set forth in the first aspect of the invention, the housing further includes a recessed formed terminal storing recess, the pair of short-circuit tabs are erected from the bottom surface of the terminal storing recess, the short-circuit terminal for conduction connecting together the pair of short-circuit tabs is stored in the terminal storing recess, and only one of the pair of short-circuit tabs is connected to the external wire.

Further, according to a third aspect of the invention, in a connector block for an injector as set forth in the first or second aspect of the invention, the subordinate bus bar groups are respectively composed of a plurality of bus bars which are held together by a holder formed of synthetic resin.

According to the first aspect of the invention, by dividing the bus bar group into the pair of subordinate bus bar groups, the end portions of the bus bar group extending in mutually different directions in correspondence to the pair of injector connecting portion groups can be held separately in the metal mold. Thanks to this, the bus bar group can be set in the metal mold including a slide mold, which makes it possible to manufacture a connector block for an injector with high efficiency. Also, in the case of the branched bus bars of the respective subordinate bus bar groups, the pair of short-circuit tabs disposed in the branched bus bars can be conduction connected with each other by an external wire or by a short-circuit terminal, whereby the branched bus bars can be short-circuited.

According to the second aspect of the invention, since the number of tabs composed of the branched bus bars and conduction connectable together by the external wire is set equal to the number of tabs in the conventional connector, as a mating-side connector to be connected to the wire connecting portion, the conventional connector as it is can be used.

According to the third aspect of the invention, in the subordinate bus bar groups, a plurality of bus bars are held together by a holder. Therefore, when compared with a structure in which bus bars are not held by a holder, the structure according to the invention is improved in the handling efficiency.

DETAILED DESCRIPTION OF THE PRESENT INVENTION

First Embodiment

Figure 1:
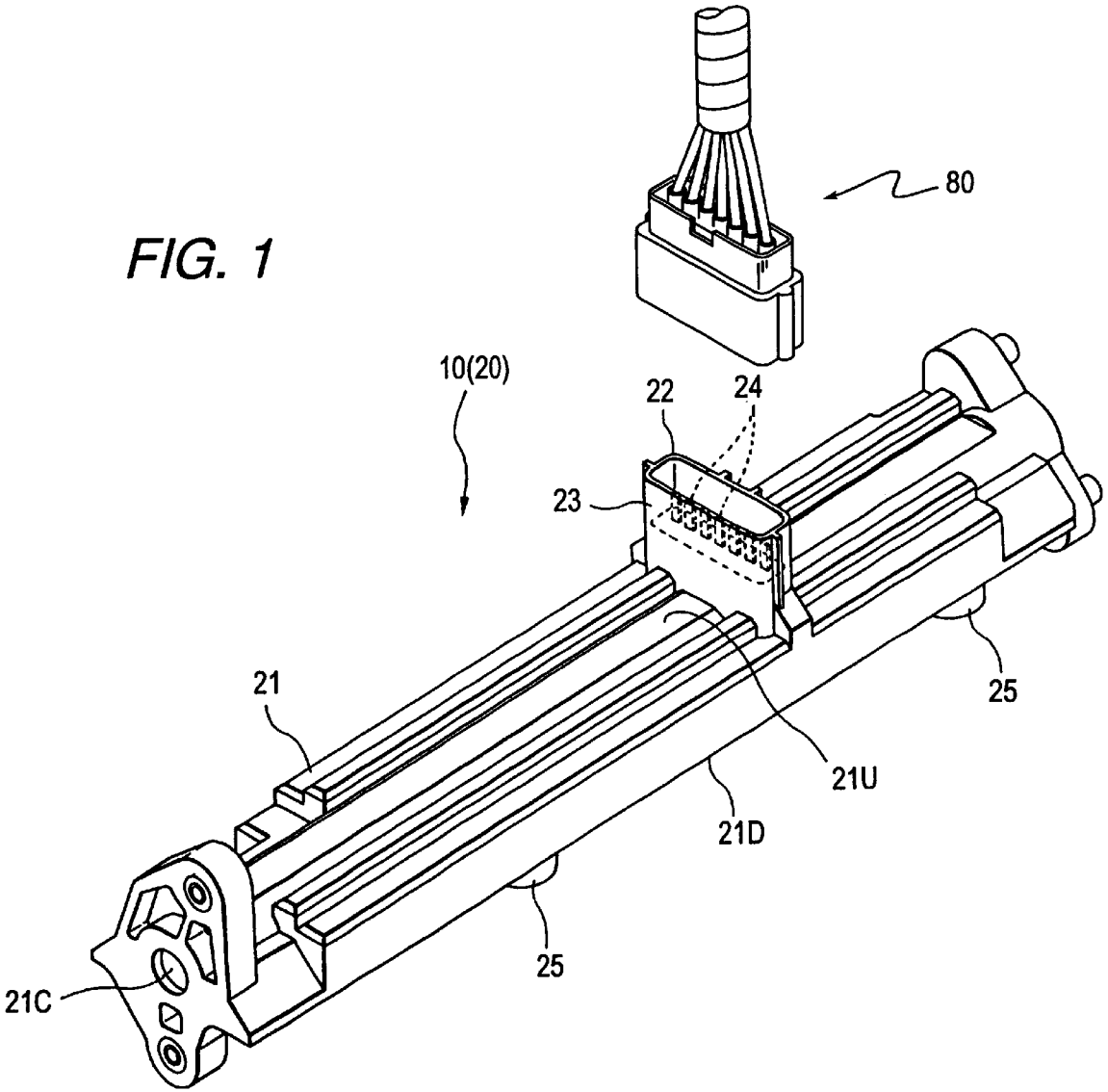
FIG. 1 is a perspective view of a first embodiment of a connector block according to the invention as well as a conventional connector block.

Now, description will be given below of a first embodiment of a connector block for an injector according to the invention with reference to FIGS. 1 to 9. A connector block 20 according to the present embodiment, as shown in FIG. 1, is substantially the same in the outer shape as the conventional connector block 10 and is to be coupled to the previously described injector 51 provided in the V-type engine. In the present embodiment, parts thereof, which are the same in structure as those employed in the conventional connector block, are given the same designations and thus will be described just supplementarily, whereas description will be given in detail of differences between the present embodiment and the conventional connector block.

Figure 2:
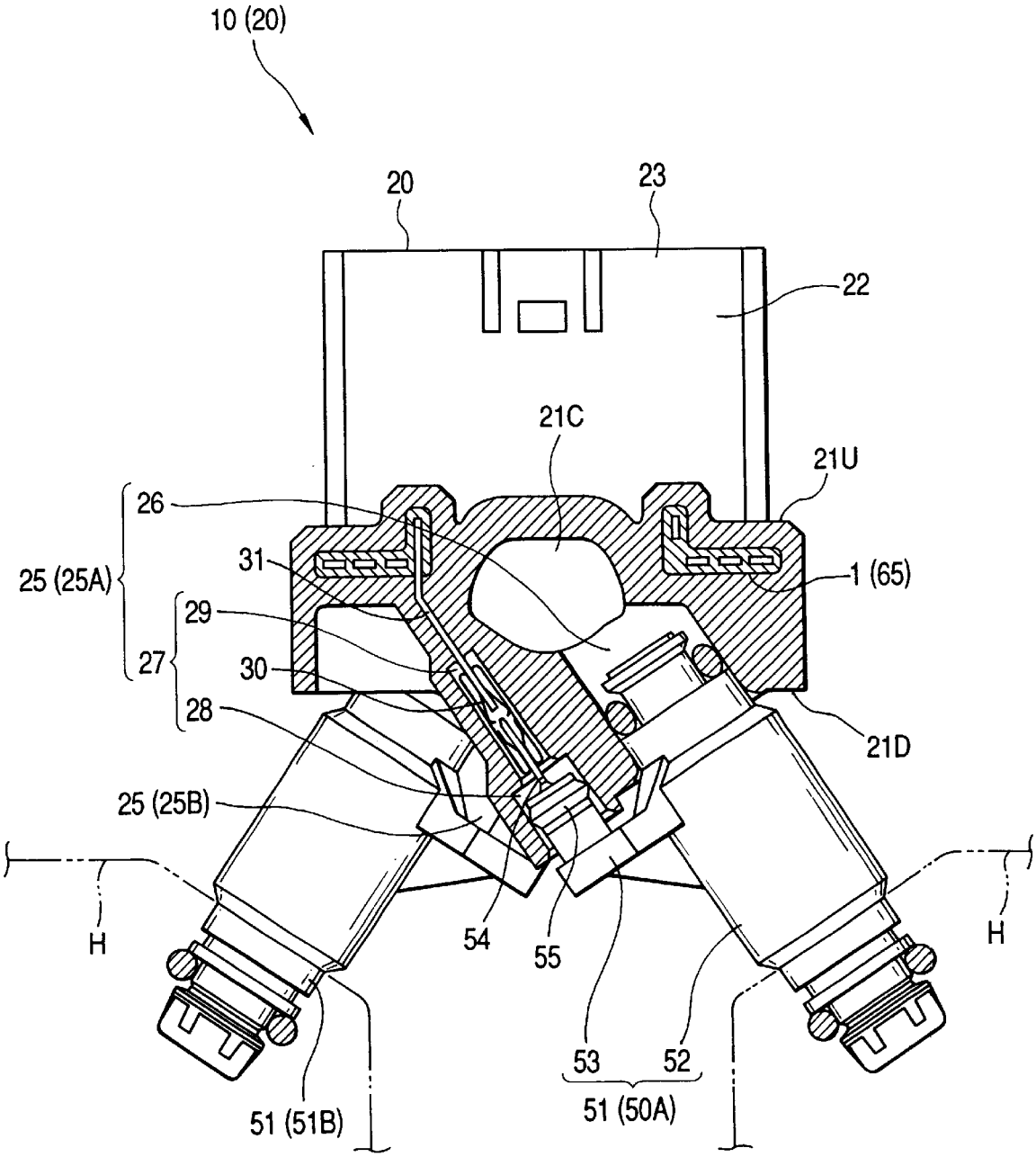
FIG. 2 is a section view of the connector block shown in FIG. 1.

Firstly, describing the structure of the injector 51 supplementarily with reference to FIG. 2, a plug portion 53 is projected laterally from the near-to-upper-end position in FIG. 2 of a cylindrical-shaped injector main body 52, and a pair of terminal pieces 54 (in FIG. 2, only one terminal piece 54 is shown) are erected upwardly from the plug portion 53 in parallel to the injector main body 52. And, when a voltage is applied between the two terminal pieces 54, a solenoid valve disposed in the interior portion of the injector main body 52 can be opened; and, normally, the solenoid valve is closed.

Here, supplementary description will be given of the housing 21 of the connector block 20 shown in FIG. 2. That is, as shown in FIG. 1, in the housing 21, there is formed a fuel supply passage 21C which extends in the longitudinal direction of the housing 21; and, fuel is supplied to the fuel supply passage 21C. Also, the housing 21 further includes a wire connecting portion 22; the wire connecting portion 22 has a hood wall 23 which stands erect upwardly from the housing 21 and has an elliptical-shaped cross section; and, a plurality of tabs 24 stand erect from the deeper-side surface of the hood wall 23.

And, the housing 21 further includes injector connecting portions 25 formed on the lower surface of the housing 21. Each of the injector connecting portions 25 includes a pipe hole 26 and a plug receiving portion 27 in a paired manner. Specifically, the pipe hole 26 communicates with the fuel supply passage 21C, while the injector main body 52 can be coupled to the pipe hole 26; and, to the plug receiving portion 27, there can be coupled the plug portion 53 formed in the injector 51. Each plug receiving portion 27 is composed of a first chamber 28 formed on the opening side thereof and a second chamber 29 formed on the deeper side thereof. Also, in the second chamber 29, there are stored a pair of relay terminals 30 (in FIG. 2, only one relay terminal 30 is shown) side by side in an insulated manner. A pair of tabs 31 (in FIG. 2, only one tab 31 is shown) are projected from the deeper side of the second chamber 29, while these tabs 31 are respectively inserted into the one-end portions of the associated relay terminals 30 and are thereby connected to the relay terminals 30. And, a waterproof pillar 55 disposed in the plug portion 53 is fitted into the first chamber 28 in sealed manner, while the terminal pieces 54 projecting from the waterproof pillar 55 are respectively inserted into the other-end portions of the associated relay terminals 30 and are thereby connected to the relay terminals 30.

The structure of the present connector block 10 described heretofore is similar to that of the conventional connector block 10.

Figure 3A:
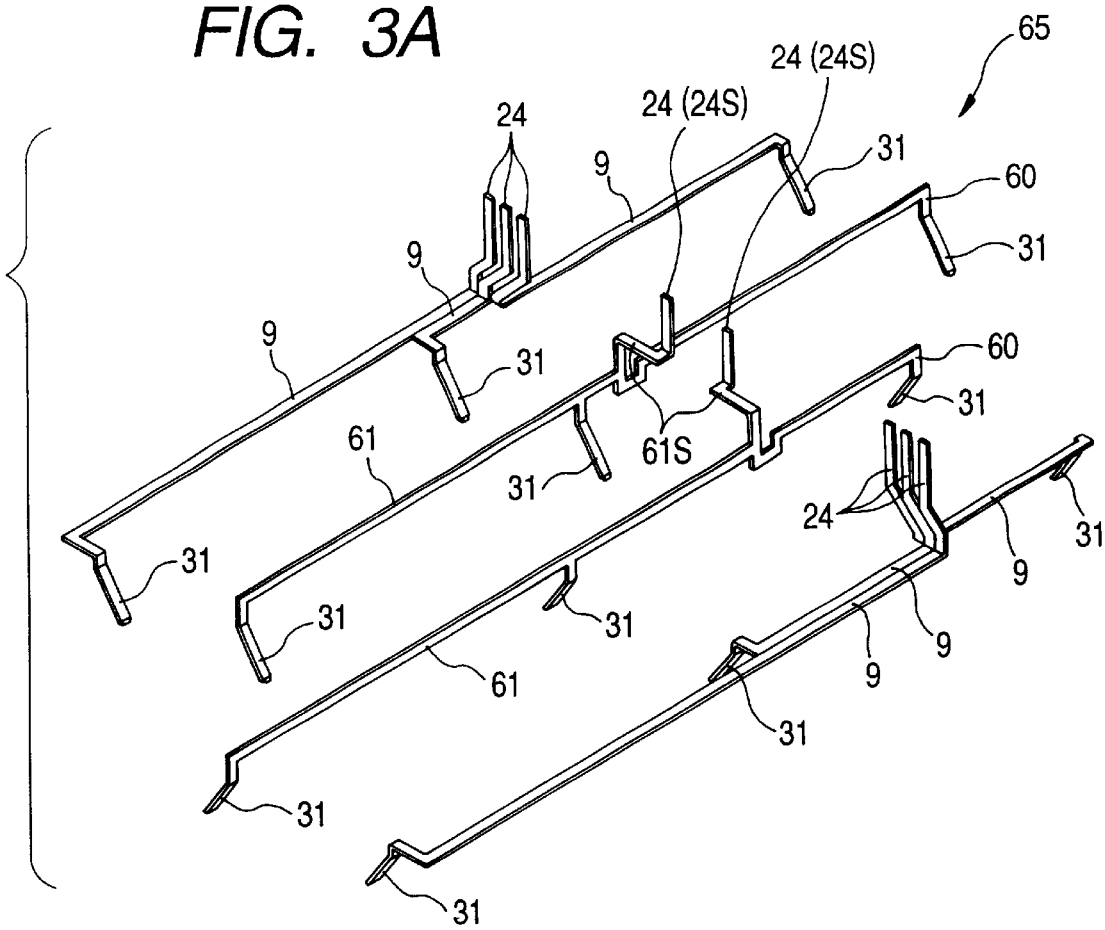
FIG. 3A is a perspective view of a plurality of bus bars incorporated in the connector block, according to the first embodiment of the invention.
Figure 16:
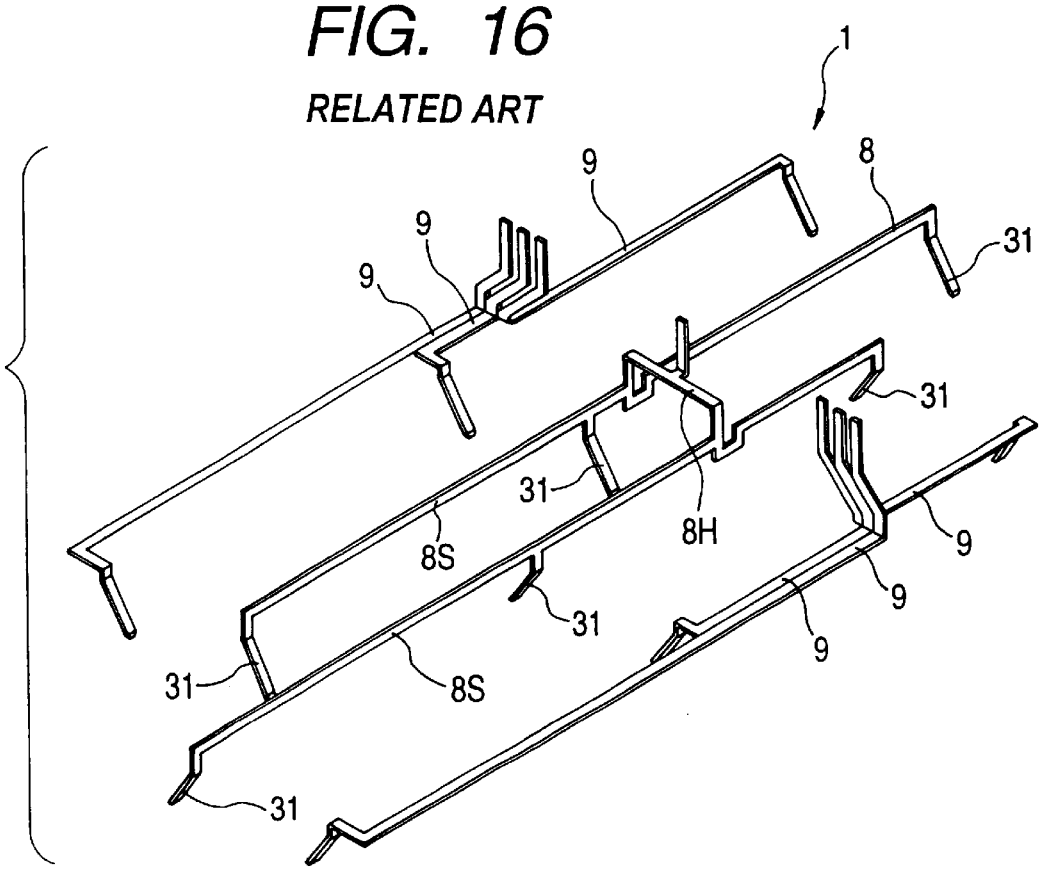
FIG. 16 RELATED ART
FIG. 16 is a perspective view of a plurality of conventional bus bars.
Figure 17:
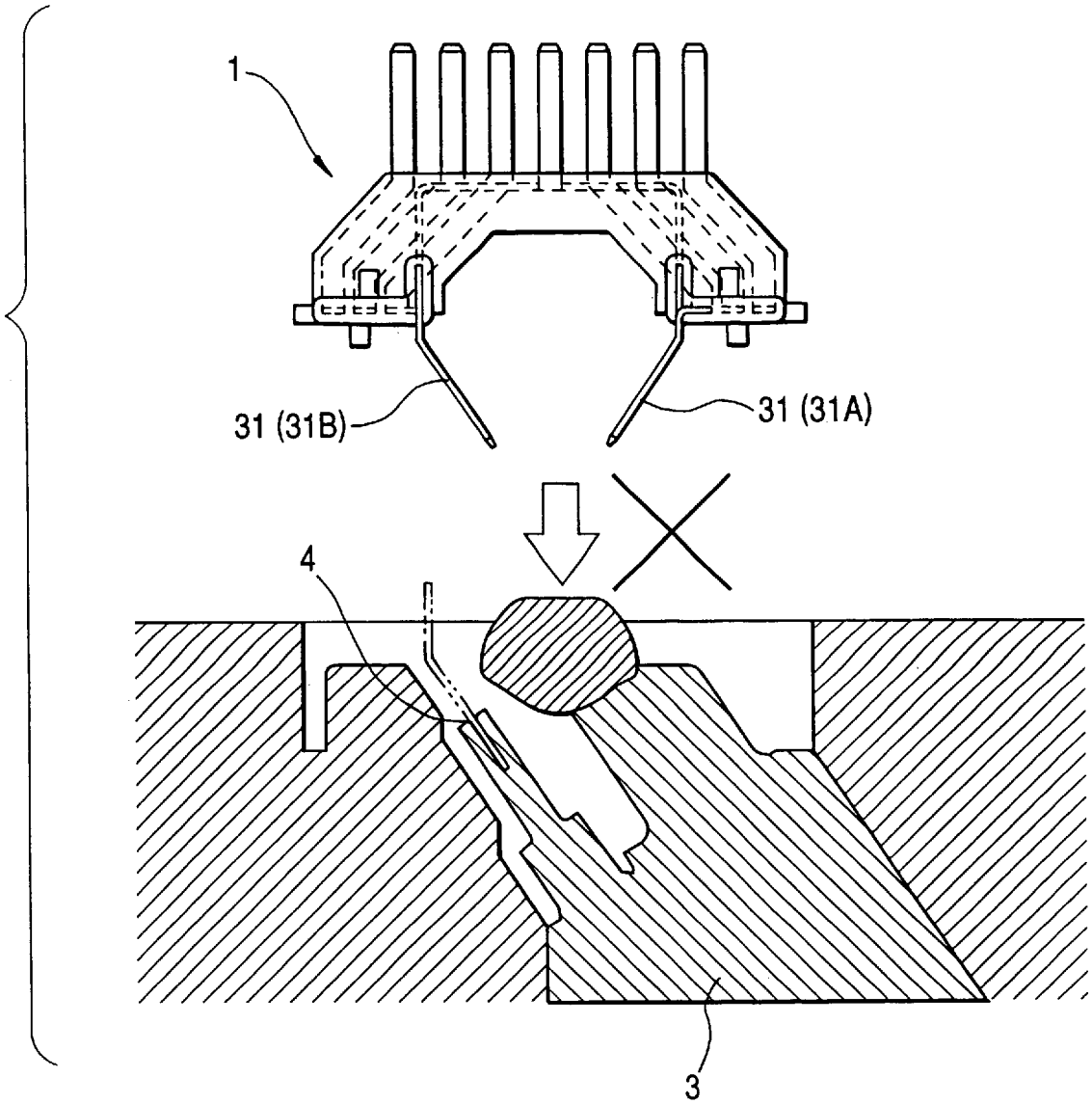
FIG. 17 RELATED ART
FIG. 17 is a side section view to show when setting the conventional bus bar group into a metal mold.
Figure 18:
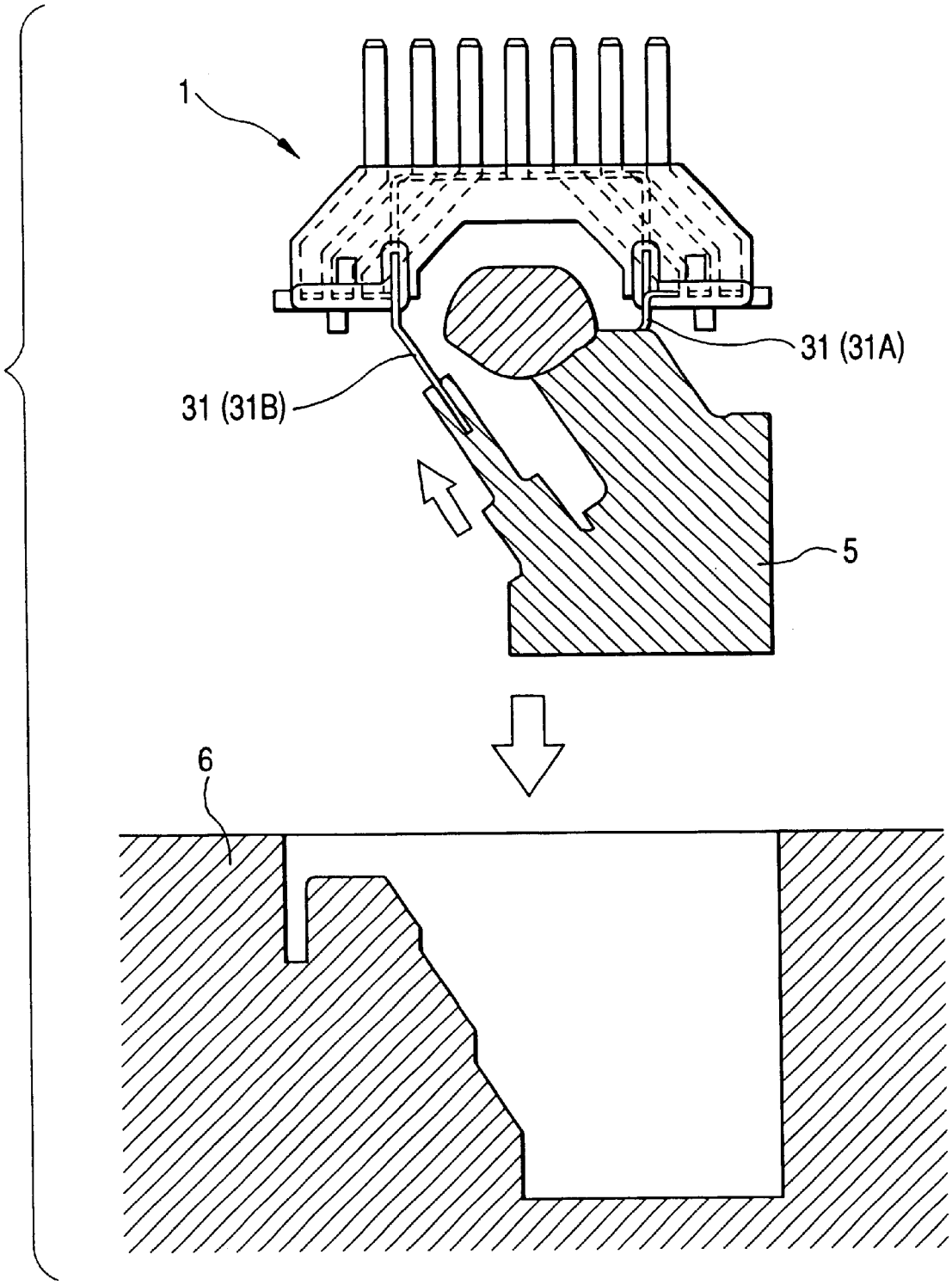
FIG. 18 RELATED ART
FIG. 18 is a side section view to show a state in which a core is mounted into the conventional bus bar group.

Now, FIG. 3A shows all bus bars of a bus bar group 65 embedded in the housing 21 in such a manner that they are compared with those of the conventional bus bar group 1 shown in FIG. 16.

The present bus bar group 65 is composed of a plurality of power supply bus bars 9 identical with the conventional bus bars and grounding bus bars 60 different from the conventional bus bars. The power supply bus bars 9, similarly to the conventional bus bars, are disposed in the same number as the injector connecting portions 25 and are insulated from each other: the one-end portions of the respective power supply bus bars 9 provide the above-mentioned tabs 24 that are collected together in the wire connecting portion 22 and are exposed there; and, the other-end portions of the respective power supply bus bars 9 form one of a pair of tabs 31, 31 disposed in each of the injector connecting portions 25.

Referring to the grounding bus bars 60, a total of two grounding bus bars are disposed: that is, one grounding bus bar 60 in one group 25A of the pair of injector connecting portion groups, one grounding bus bar 60 in the other group 25B. Each grounding bus bar 60 includes a plurality of branch portions which project obliquely downward from a plurality of positions of the main body portion 61 of the grounding bus bar 60, while the main body portion 61 extends along the longitudinal direction of the housing 21. These branch portions form the remaining one of the pair of tabs 31, 31. Also, the two grounding bus bars 60 respectively include branch portions 61S which project from the intermediate portions of their respective main body portions 61 and approach each other; the leading ends of the branch portions 61S are bent upwardly at right angles; and, the leading ends of the right-angle bent portions form short-circuit tabs 24S of the tabs 24 exposed in the wire connecting portion 22, respectively.

Figure 3B:
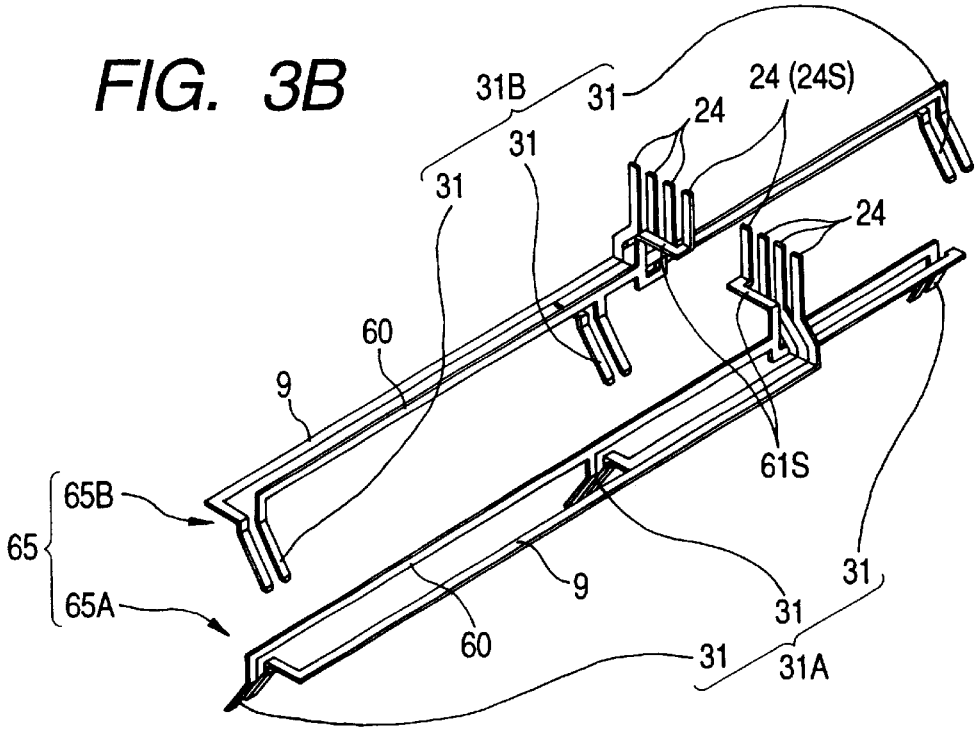
FIG. 3B is a perspective view of the plurality of bus bars when they are divided into two subordinate bus bar groups, according to the first embodiment of the invention.
Figure 4:
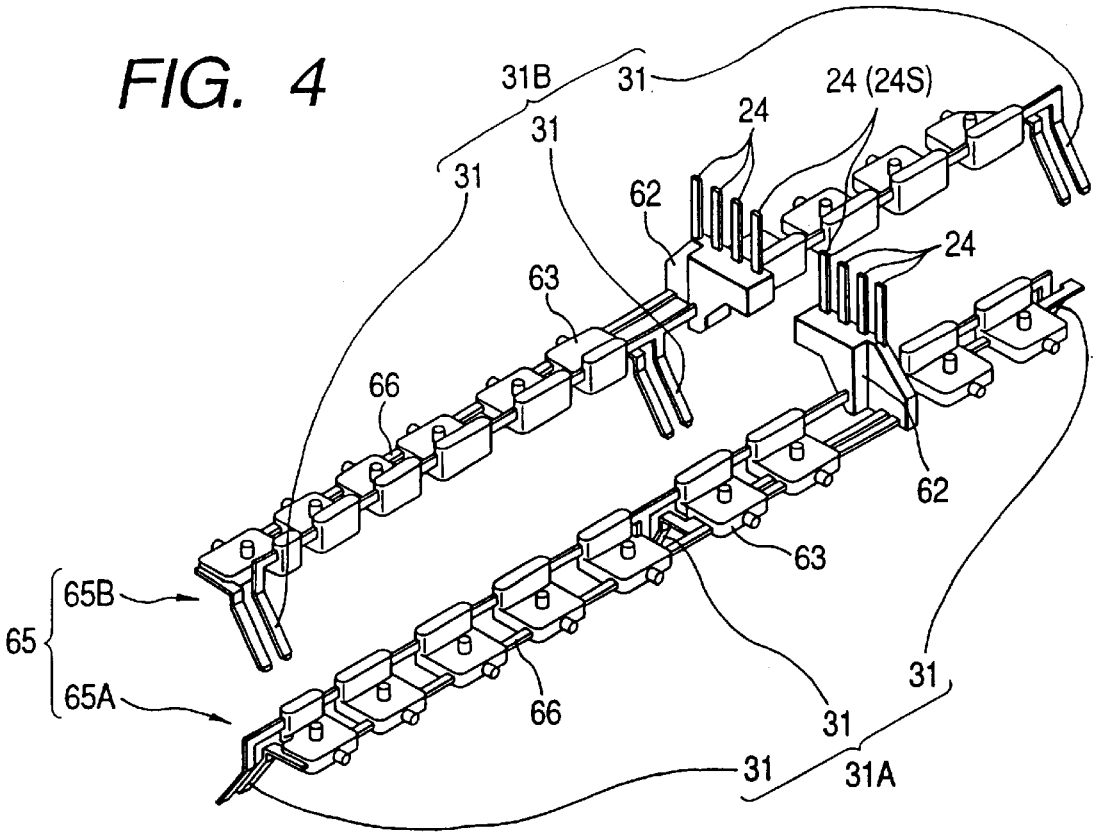
FIG. 4 is a perspective view of a pair of subordinate bus bar groups, according to a first embodiment of the invention.
Figure 5:
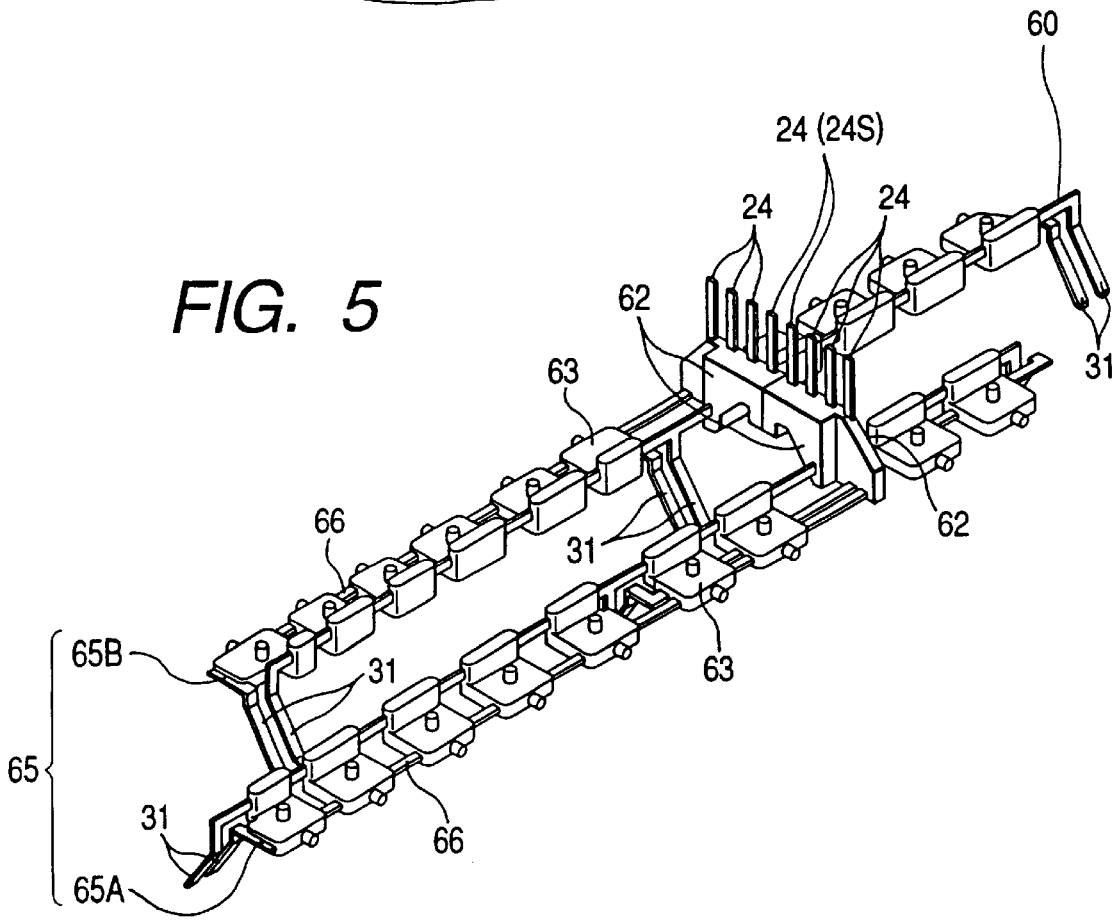
FIG. 5 is a perspective view of the pair of subordinate bus bar (groups, showing a state in which they are connected together, according to a first embodiment of the invention.

The bus bar group 65, as shown in FIG. 3B, can be divided into two subordinate bus bar groups 65A and 65B which correspond to the pair of injector connecting portion groups 25A and 25B. And, to manufacture these subordinate bus bar groups 65A and 65B, they may be set in a metal mold for primary molding and a plurality of synthetic resin holders 62, 63, 63, - - - shown in FIG. 4 may be insert molded, thereby producing a structure in which a plurality of bus bars are collected together and held in an insulated manner. The details of this structure are as follows. That is, the two subordinate bus bar groups 65A and 65B are structured such that, as shown in FIG. 4, from the intermediate portions of the rail portions 66 thereof extending along the longitudinal direction of the housing 21, there are projected horizontal holders 62 in such a manner as to approach each other. Also, from the plurality of positions of the respective rail portions 66, there are projected the above-mentioned pair of tabs 31, 31; and, the above-mentioned plurality of tabs 24 extend upwardly from the respective horizontal holders 62. Further, the short-circuit tabs 24S, 24S are situated on the leading end sides of the respective horizontal holders 62, 62 and adjoin each other.

Next, while explaining the steps of manufacturing the connector block 20 according to the present embodiment, description will be given below of the operation of the present embodiment.

Firstly, the plurality of bus bars shown in FIG. 3A are set in the primary molding metal mold and are then collected together into the holders 62, 63 in the above-mentioned manner to thereby provide the pair of subordinate bus bar groups 65A and 65B shown in FIG. 4.

Figure 6:
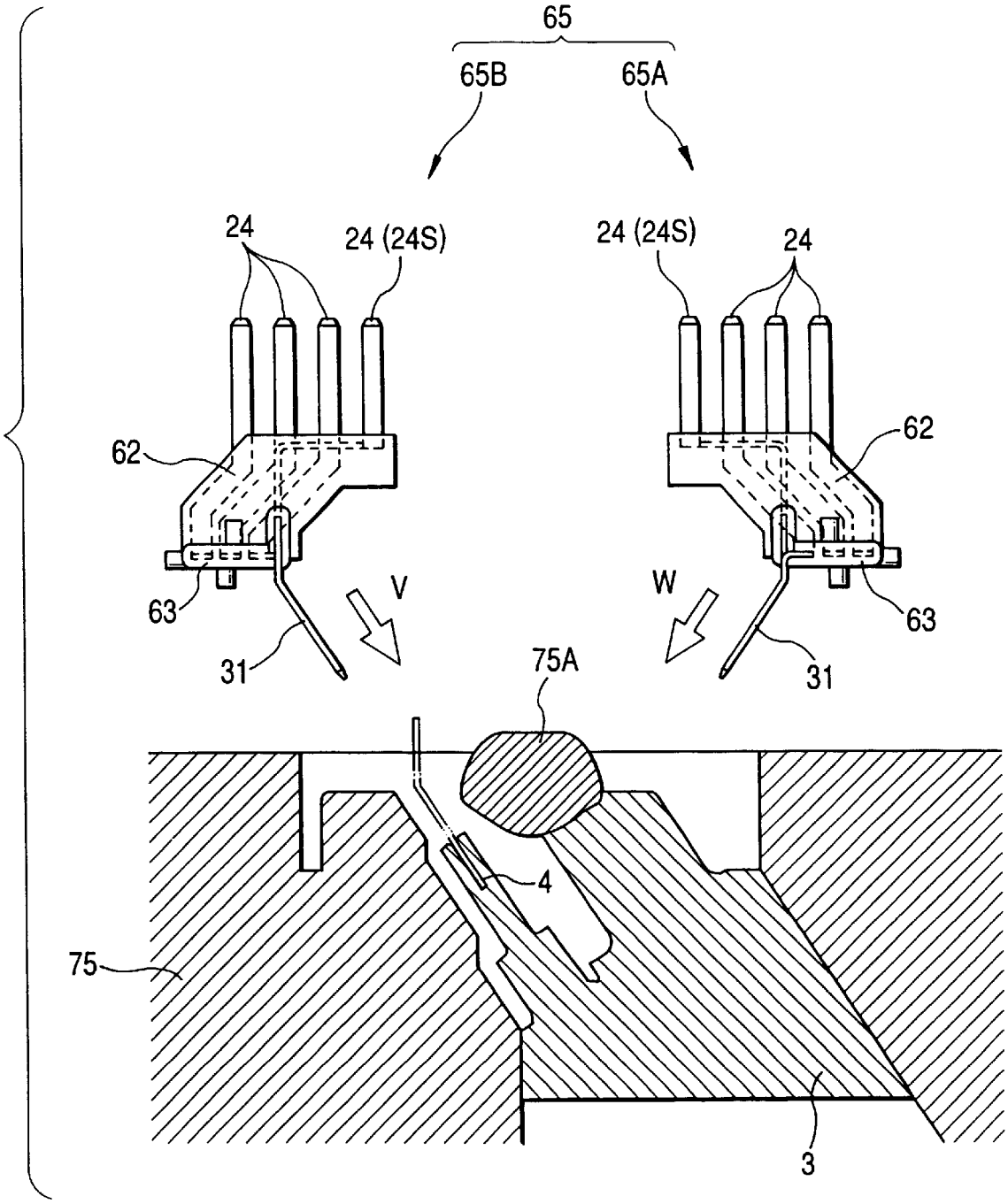
FIG. 6 is a side section view to show a state in which the two subordinate bus bar groups are set into a metal mold while they are separated from each other.

Next, the two subordinate bus bar groups 65A and 65B are separated from each other and, as shown in FIG. 6, they are respectively set in a metal mold 75 including a slide mold 3.

Figure 7:
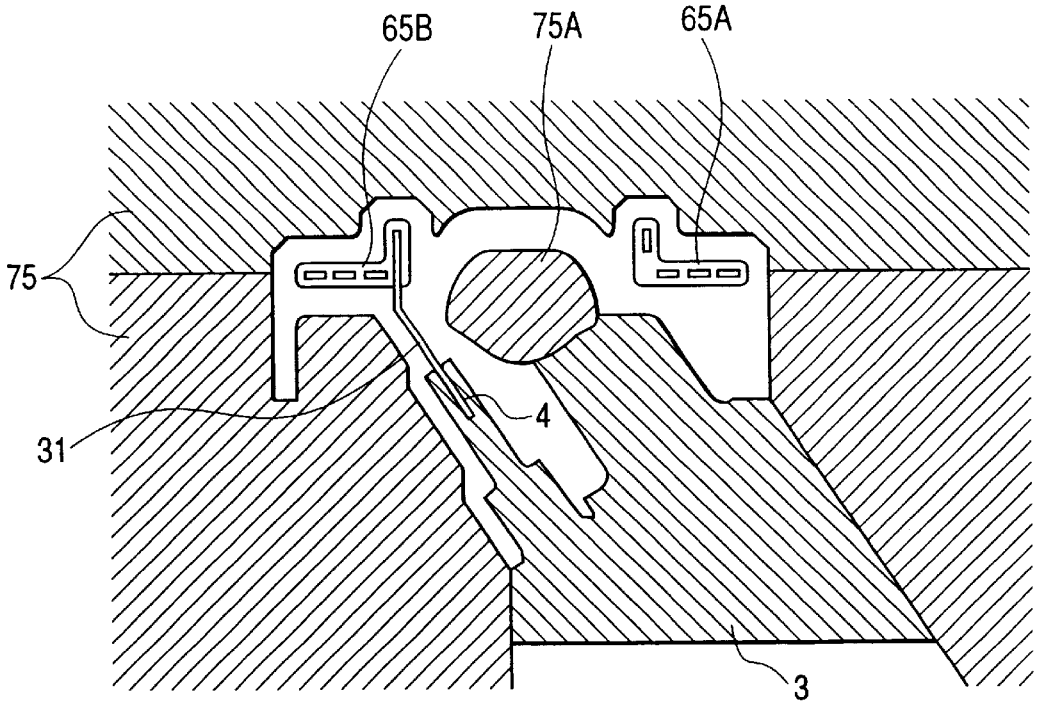
FIG. 7 is a side section view to show a state in which the metal mold is closed.

Specifically, the subordinate bus bar group 65B shown on the left in FIG. 6 is moved right and downward in FIG. 6 (see an arrow mark V shown in FIG. 6) to insert the tab 31 into a tab hold hole 4 formed in the slide mold 3, while the subordinate bus bar group 65A shown on the right in FIG. 6 is moved left and downward in FIG. 6 (see an arrow mark W shown in FIG. 6) to insert the tab 31 into a tab hold hole 4 formed in the other slide mold (not shown), whereby the two subordinate bus bar groups 65A and 65B are set in the metal mold 75. And, as shown in FIG. 7, the metal mold 75 is closed and synthetic resin is filled into the interior portion of the metal mold 75. As a result of this, the pair of subordinate bus bar groups 65A and 65B are covered with the housing 21.

Figure 8:
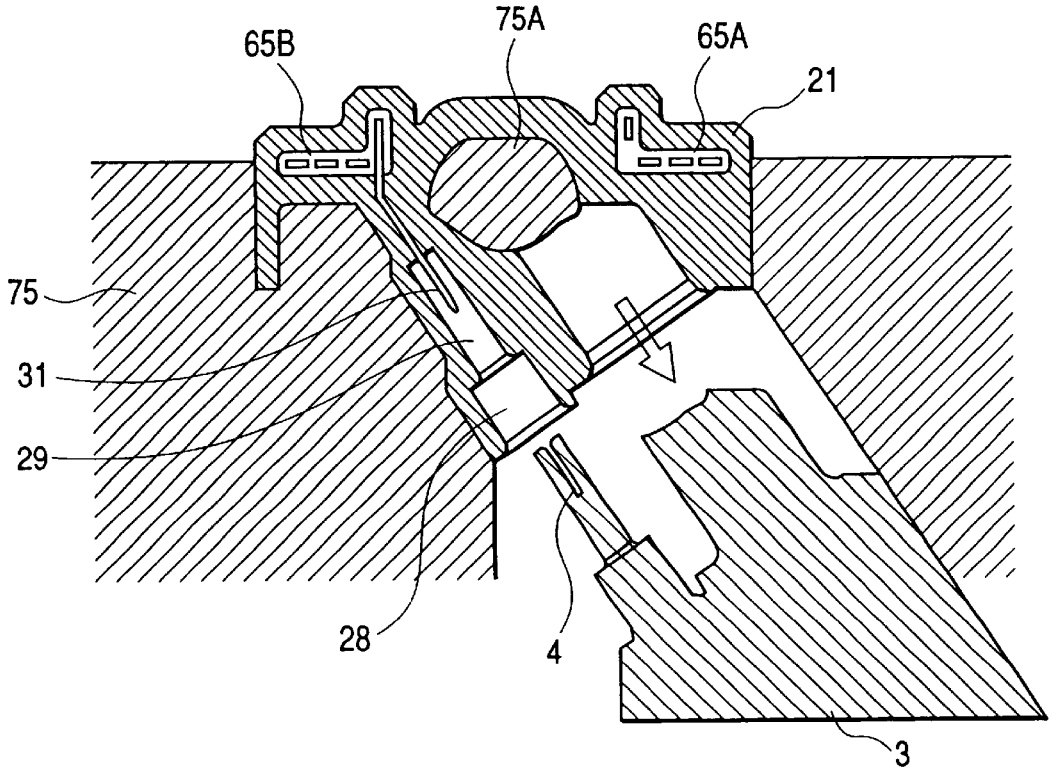
FIG. 8 is a side section view to show a state in which a slide mold is retreated.
Figure 9:
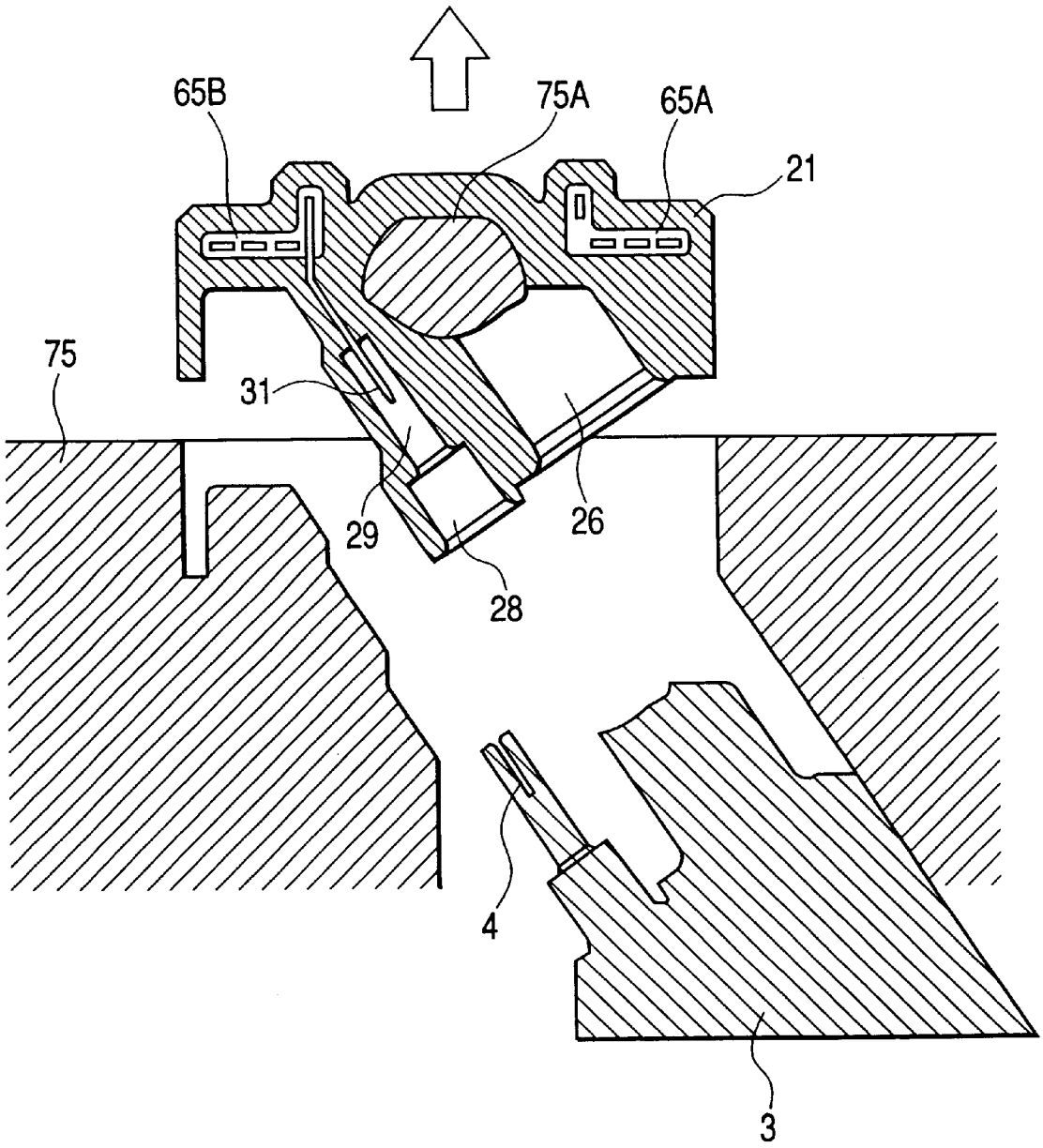
FIG. 9 is a side section view to show a state in which a product is removed from a metal mold main body.

Next, as shown in FIG. 8, the slide mold 3 is retreated; as shown in FIG. 9, the connector block 20 is removed in the mold opening direction of the metal mold 75; and, further, a metal mold 75A for molding the fuel supply passage 21C of the connector block 20 is pulled out. And, finally, the relay terminal 30 (see FIG. 2) is inserted into the injector connecting portion 25, which completes the connector block 20.

When the completed connector block 20 is connected to an external wire 80, shown in FIG. 1, the short-circuit tabs 24S, 24S extended from the pair of grounding bus bars 60 are short-circuited by the external wire 80.

As described above, according to the present embodiment, since the bus bar group 65 can be set in the metal mold including the slide mold 3 while the bus bar group 65 is separated into the pair of subordinate bus bar groups 65A, 65B, when compared with the conventional connector block manufacturing method using a core, the connector block 20 can be manufactured with high efficiency. Also, because the subordinate bus bar groups 65A, 65B are structured such that a plurality of bus bars are held by the holders 62, 63, when compared with a structure different from this, the subordinate bus bar groups 65A, 65B can be handled easily thereby be able to enhance the efficiency of the operation to set the bus bar group 65 into the metal mold.

Second Embodiment

Now, FIGS. 10 to 14 show a second embodiment of a connector block according to the invention. The present embodiment is different from the previously described first embodiment in the structure for short-circuiting a pair of grounding bus bars. In the present embodiment, parts thereof identical in structure with those of the first embodiment are given the same designations and the duplicate description thereof is omitted; and, description will be given below only of the portions thereof different in structure from the first embodiment.

Figure 10:
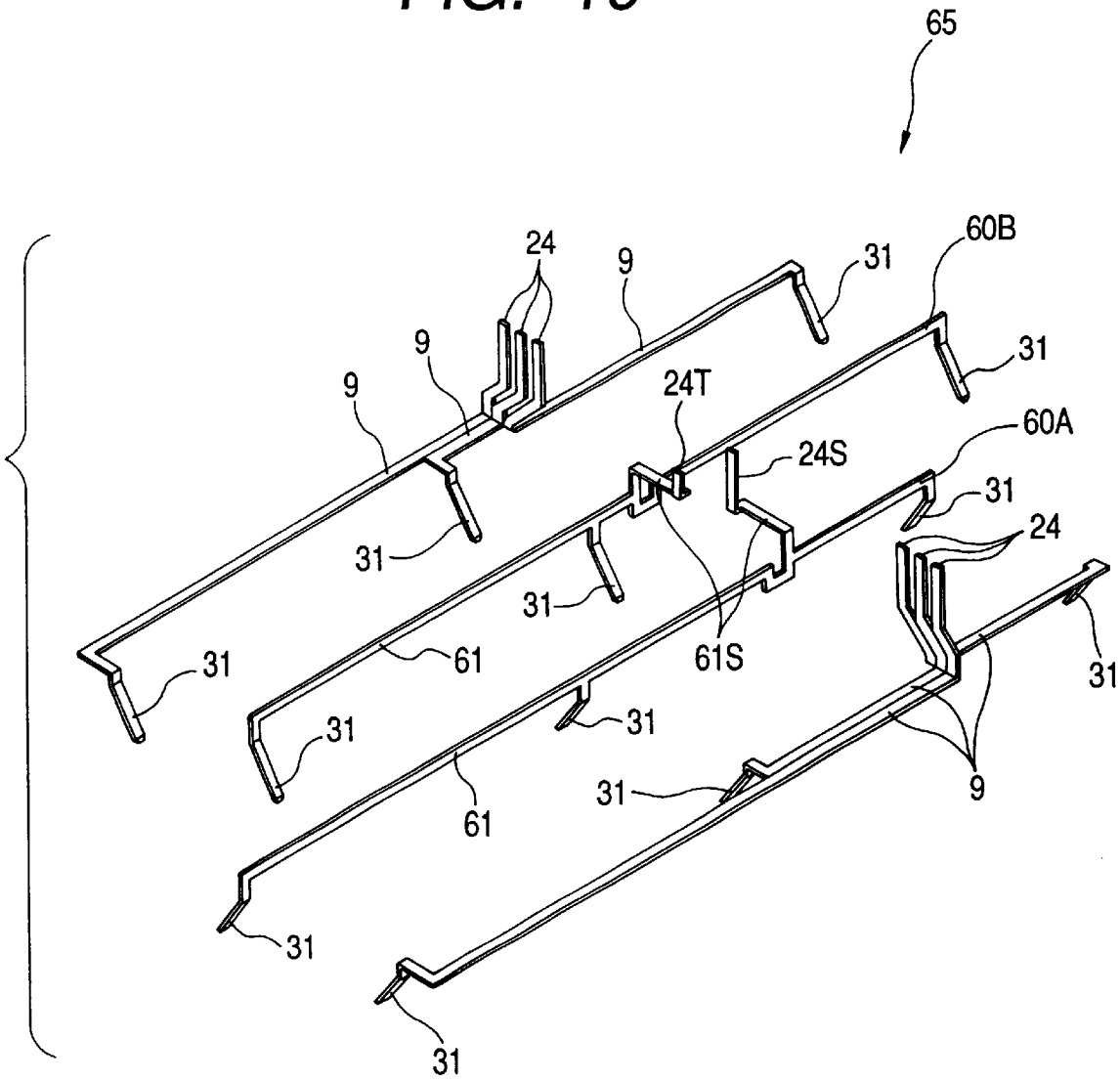
FIG. 10 is a perspective view of a plurality of bus bars according to a second embodiment of the invention.

A plurality of bus bars according to the present embodiment are shown in FIG. 10. Specifically, one grounding bus bar 60A, similarly to the first embodiment, includes a short-circuit tab 24S projected upwardly, whereas the other grounding bus bar 60B includes a subordinate short-circuit tab 24T which is shorter than the short-circuit tab 24S and is projected upwardly.

Figure 11:
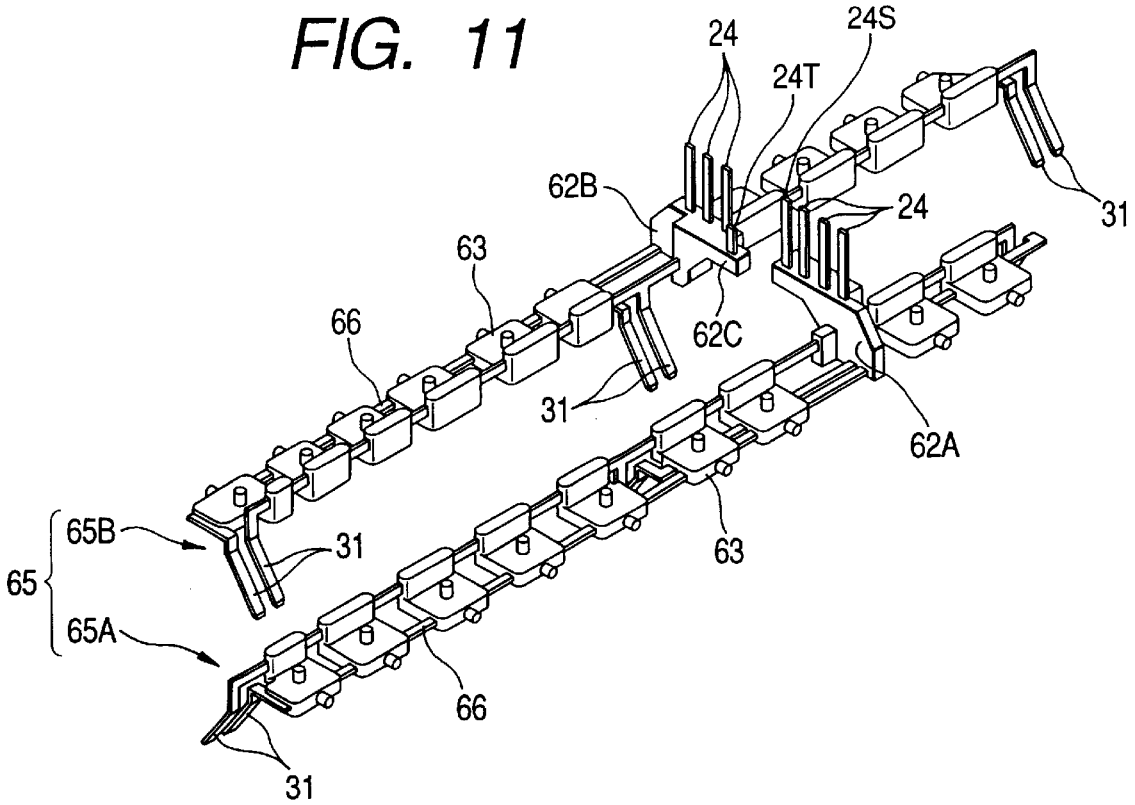
FIG. 11 is a perspective view of a pair of subordinate bus bar groups.

These short-circuit tabs 24S, 24T, as shown in FIG. 11, are projected upwardly from the leading ends of the horizontal holders 62A, 62B of the respective subordinate bus bar groups 65A, 65B, respectively.

Figure 12:
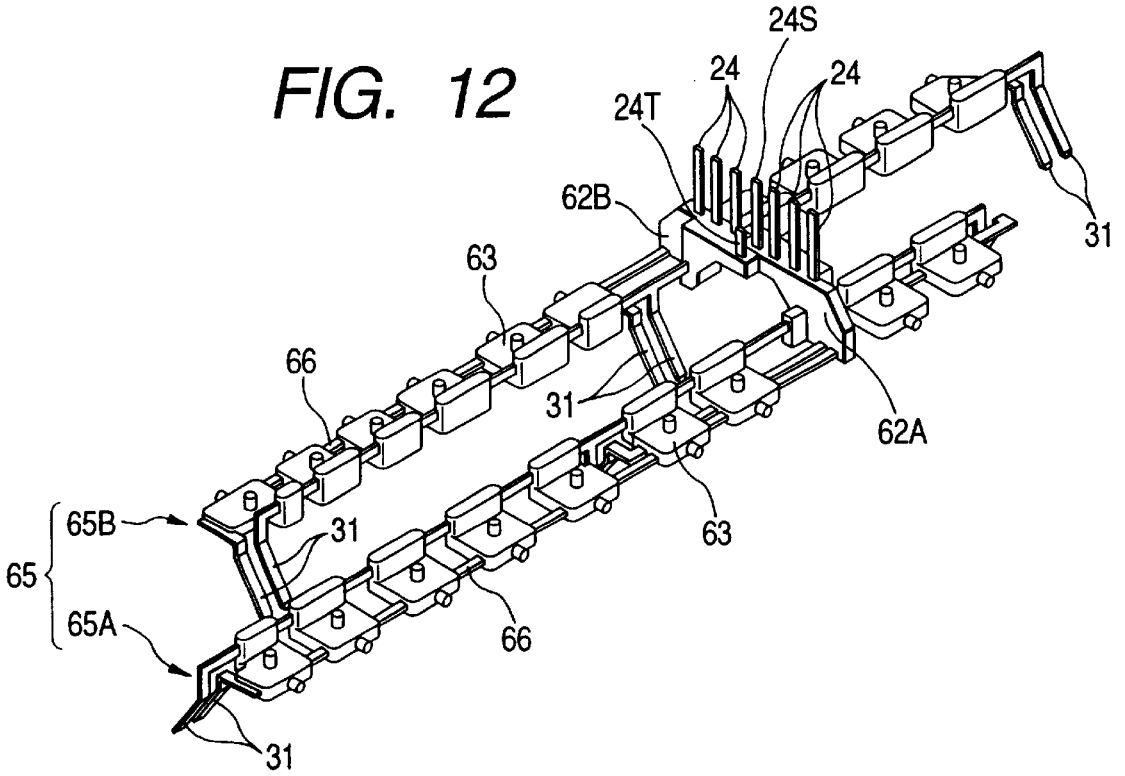
FIG. 12 is a perspective view of the pair of subordinate bus bar groups, showing a state in which they are connected together.

Also, the subordinate short-circuit tab 24T is shifted from the arranging direction of tab groups 24 respectively formed of power supply bus bars 9 of the horizontal holder 62B and is also positioned nearer to the leading end side of the horizontal holder 62 than the tab groups 24. Also, the portion of the horizontal holder 62B where the subordinate short-circuit tab 24T is disposed is formed as a projecting portion 62C which projects toward a mating-side horizontal holder 62A. And, in case where the subordinate bus bar groups 65A, 65B are set in a metal mold, as shown in FIG. 12, the projecting portion 62C is superimposed on top of the longitudinal-direction front portion of the subordinate bus bar group 65A. Due to this, the short-circuit tab 24S can be situated in the center of the plurality of tab groups 24 formed of the power supply bus bars 9, and the subordinate short-circuit tab 24T can be positioned adjacently to and in front of the short-circuit tab 24S.

Figure 13:
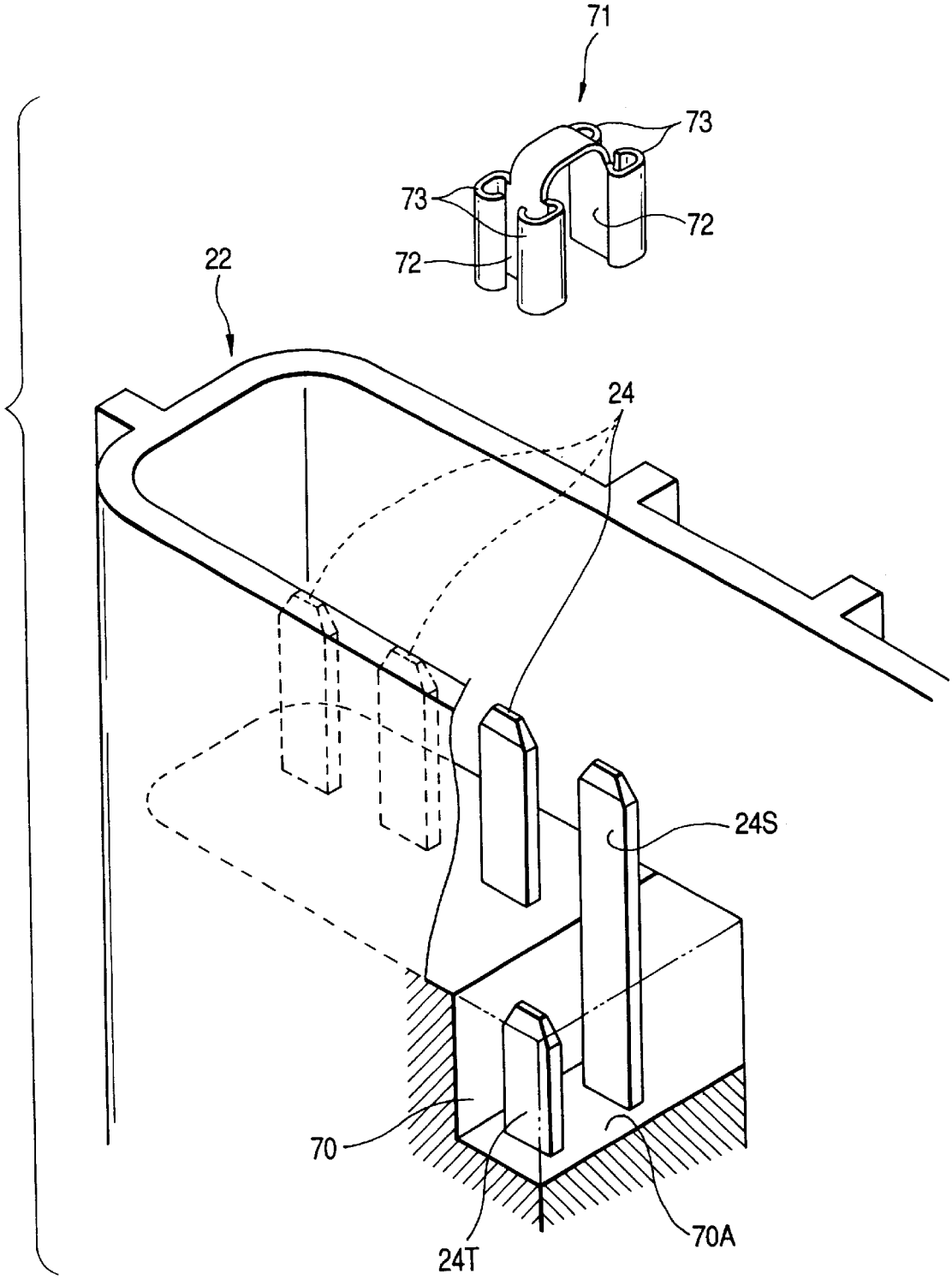
FIG. 13 is a perspective view of a short-circuit terminal and a terminal storing recess.
Figure 14:
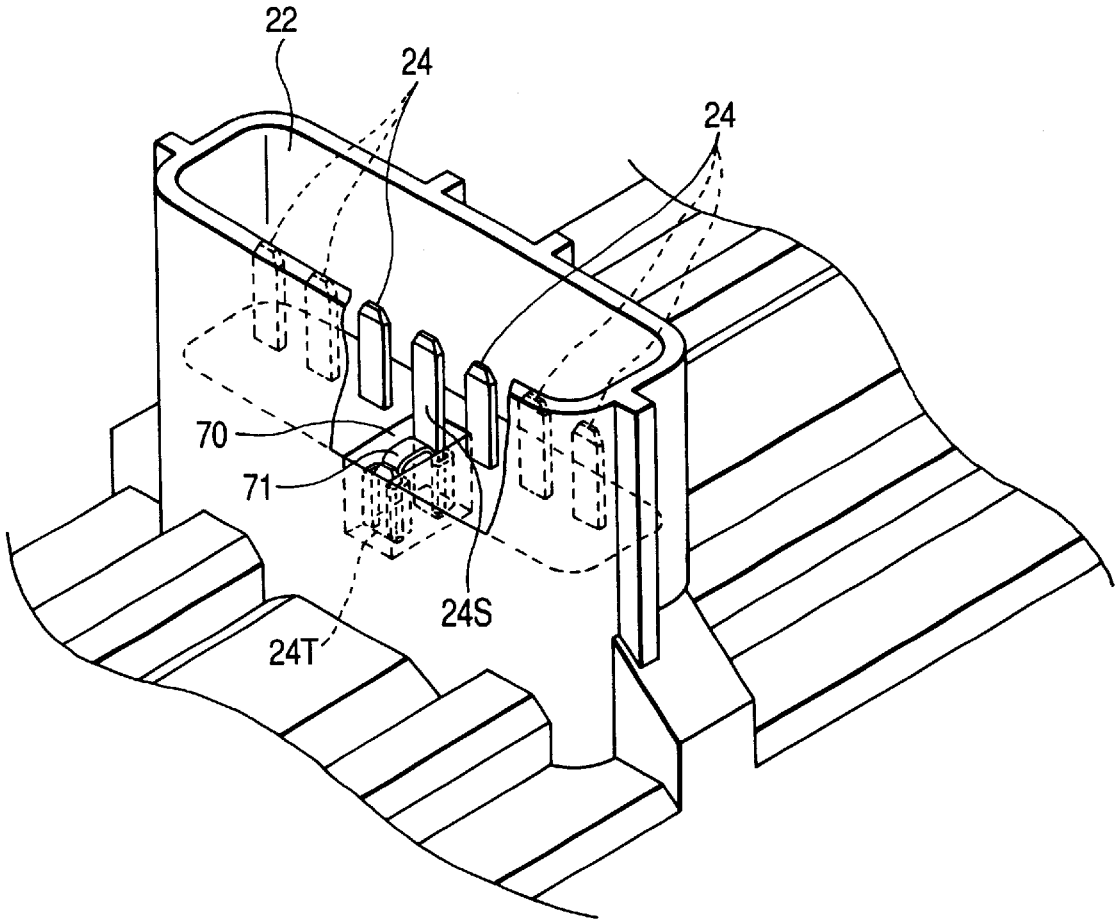
FIG. 14 is a perspective view to show a state in which the short-circuit terminal is stored in the terminal storing) recess.
Figure 15:
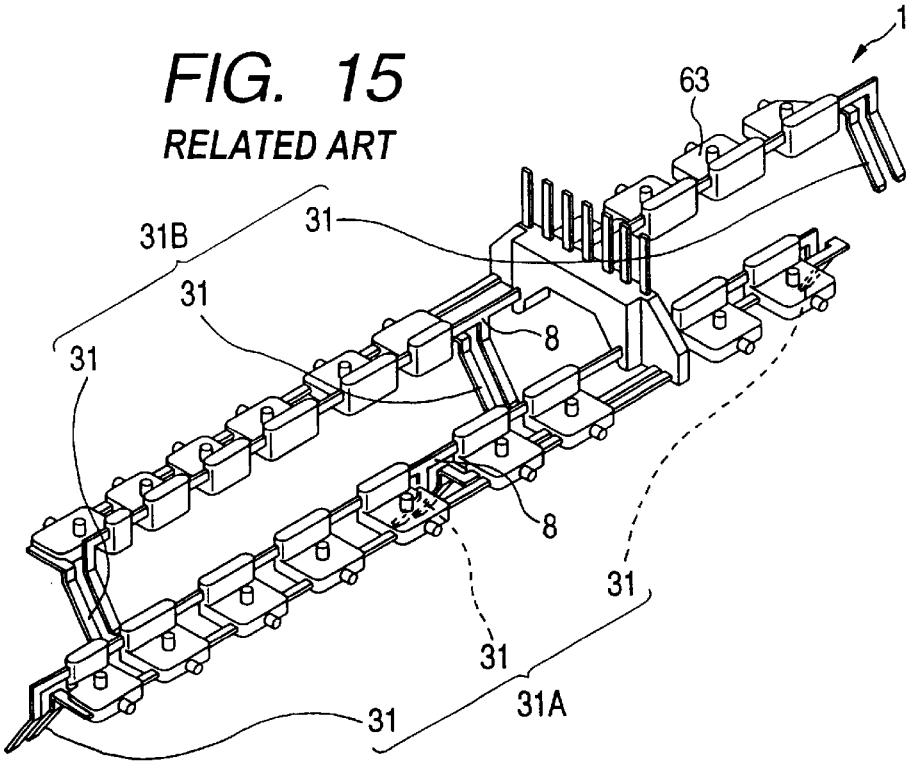
FIG. 15 RELATED ART
FIG. 15 is a perspective view of conventional bus bar group.

Also, as shown in FIG. 13, in the wall surface of the housing 21 where the short-circuit tabs 24S, 24T of the wire connecting portion 22, there are recessed formed a terminal storing recess 70 having a rectangular-shaped section; the short-circuit tab 24S is erected from the longitudinal-direction near-to-one end position of the bottom surface 70A of the terminal storing recess 70 and is projected externally of the terminal storing recess 70; and, the subordinate short-circuit tab 24T is erected from the near-to-the-other-end position of the bottom surface 70A and is stored into the terminal storing recess 70. And, into the terminal storing recess 70, there is stored a short-circuit terminal 71 shown in FIG. 13 and, as shown in FIG. 14, the two short-circuit tabs 24S, 24T are short-circuited. Specifically, the short-circuit terminal 71 has a structure in which a pair of so called FACEDOWN terminals are connected together. Referring in detail to the structure of the short-circuit terminal 71, as shown in FIG. 13, a metal plate is bent into a gate shape to thereby form a pair of opposing pieces 72, 72; two blade pieces 73, 73 formed continuously with the two side edge portions of each of the opposing pieces 72, 72 are bent on the opposite side to the mating-side opposing piece 72, and the leading ends of the blade pieces 73, 73 are butted against the flat surfaces of the respective opposing pieces 72; and, the short-circuit tabs 24S, 24T can be held by and between gaps formed between the butted portions.

The above structure according to the second embodiment can also provide similar operation and effects to the first embodiment. At the same time, according to the second embodiment, only one (24S) of the short-circuit tabs 24S, 24T disposed in the wire connecting portion 22 is connected to the external wire and the other (24T) need not be connected to the external wire and, therefore, the number of tab groups to be provided in the wire connecting portion 22 can be set equal to the number of tab groups employed in the conventional connector block, which makes it possible to use a conventional connector which is provided in the terminal of the external wire.

Other Embodiments

The present invention is not limited to the above-illustrated embodiments but, for example, other embodiments which will be discussed below also fall under the technical scope of the invention and further, besides the following embodiments, various changes and modifications are also possible without departing from the scope of the subject matter of the invention.

(1) In the above-mentioned embodiments, the subordinate bus bar groups 65A, 65B are respectively structured such that a plurality of bus bars are collected together by the holders 62, 63. However, there can also be employed a structure in which these bus bars are not collected together by the holders.

(2) The holder may be structured in a different manner. That is, the holder may be firstly molded with the bus bars not inserted therein and, after molded, it may be mounted over the bus bars.

(3) In the above-mentioned embodiments, there are illustrated a structure in which the branched bus bars according to the invention are used for grounding. However, alternatively, the branched bus bars may be used for power supply.

What is claimed is:

1. A connector block for use with an injector and at least one of an external wire and a short circuit terminal, the connector block comprising:

a bus bar group including two subordinate bus bar groups each having a plurality of bus bars which are not electrically connected with each other;

a housing molded by setting the bus bar group in a metal mold for resin molding, the housing including:

a wire connecting portion for connecting the plurality of bus bars to a plurality of external wires; and two injector connecting portion groups including a plurality of injector connecting portions in each of the two subordinate bus bar groups, the pair of injector connecting portion groups disposed in a lower surface of the housing for connecting the plurality of bus bars to a plurality of injectors from mutually different oblique downward directions, wherein the two subordinate bus bar groups are molded in the metal mold in correspondence to the pair of injector connecting portion groups, wherein the plurality of bus bars arc branched from the wire connecting portion and respectively extending to the plurality of injector connecting portions, and wherein the plurality of bus bars include a pair of short-circuit tabs, wherein only one of the short circuit tabs extends to the connecting portion, the short circuit tabs being electrically connected with each other by the at least one of external wire and the short-circuit terminal.

2. The connector block as set forth in claim 1, wherein the housing includes a terminal storing recess, the pair of short-circuit tabs are erected from a bottom surface of the terminal storing recess, the short-circuit terminal for electrically connecting the pair of short-circuit tabs is stored in the terminal storing recess, and only one of the pair of short-circuit tabs is connected to the external wire.

3. The connector block as set forth in claim 1, wherein a holder formed of synthetic resin holds the plurality of bus bars in each of the two subordinate bus bar groups.

* * * * *